United States Patent [19]

Baus

[11] Patent Number: 4,570,617

[45] Date of Patent: Feb. 18, 1986

[54] MASSAGING DEVICE

[76] Inventor: Heinz G. Baus, 35, Wartobodenstrasse, CH-3626 Hünibach-Thun, Switzerland

[21] Appl. No.: 575,912

[22] Filed: Feb. 1, 1984

[30] Foreign Application Priority Data

Feb. 5, 1983 [DE] Fed. Rep. of Germany ..... 3303925

[51] Int. Cl.[4] ..... A61H 7/00

[52] U.S. Cl. ..... 128/52; 74/31; 74/33; 74/422; 128/65; 188/65.1; 188/65.4

[58] Field of Search ..... 128/56, 65, 66, 52, 128/51, 53; 188/65.1, 65.4; 74/31, 33, 422

[56] References Cited

U.S. PATENT DOCUMENTS

| | | | |
|---|---|---|---|
| 123,043 | 1/1872 | Palmer | 188/65.1 |
| 620,630 | 3/1899 | Yates | 74/31 |
| 854,922 | 5/1907 | Bergquist | 188/65.4 |
| 915,245 | 3/1909 | Stoland | 74/31 |
| 2,244,607 | 6/1941 | Blakeley | 74/31 |
| 2,490,970 | 12/1949 | Krassilnikian | 74/33 |
| 2,926,533 | 3/1960 | Markoski | 74/422 |
| 3,123,182 | 3/1964 | Malone | 188/65.1 |
| 4,351,417 | 9/1982 | Seiz | 188/65.1 |

*Primary Examiner*—Clyde I. Coughenour

*Attorney, Agent, or Firm*—Schwartz, Jeffery, Schwaab, Mack, Blumenthal & Evans

[57] ABSTRACT

Massaging device comprising a slide movable back and forth along a stationary guide, a massaging brush arranged rotatably upon the slide and rotated, through a shaft, by a motor, and a reversing drive driven by the motor. The direction of motion of the slide is predeterminable and the reversing drive is adapted to be connected to the guide by means of a first gearwheel. The motor is arranged stationarily and the slide is locked in a predeterminable position while the massaging brush continues to rotate. There is provided an endless belt running over two deflecting rollers spaced from each other and driven by the stationarily arranged motor. The slide has a drive-wheel which is connected to the shaft and is in engagement with the belt, the reversing drive, driven by the drive-wheel, is mounted on a drive-carrier which moves upon the slide, the reversing drive being selectively connected to, or disconnected from, the guide and the slide being locked in relation thereto by means of a switching element.

16 Claims, 4 Drawing Figures

MASSAGING DEVICE

The invention relates to a massaging device comprising a slide adapted to move back and forth along a stationary guide, with a massaging brush arranged rotatably upon the slide and rotated, through a shaft, by means of a motor, and with a reversing drive adapted to be driven by the motor, whereby the direction of motion of the slide may be predetermined, and adapted to be connected to the guide by means of a first gearwheel.

A massaging device of this kind is described in Germany Utility Model No. 77 29 478 in which an electric motor is provided upon the slide as a drive for the massaging brush. This motor also drives, through a reversing drive, a pinion engaging in a stationary guide. Also provided is a clutch with which a change-over switch is associated. The arrangement of the clutch and motor upon the slide results in a great overall weight and the massaging device as a whole, and the guide, in particular, must be sized accordingly. Supplying power to the slide through a cable is an additional expense and, if the unit is installed in wet surroundings, for example a shower-room, additional safety precautions are needed and, usually, a transformer. Since the motor is coupled directly both to the massaging brush and, through the pinion, to the guide, the massaging brush can rotate only if the slide is in motion; it cannot rotate while the slide is stationary.

German published application No. 23 06 904 also describes a massaging unit which comprises not only an endless belt which rotates the massaging brush, but also an additional roller-chain to which the slide is hinged by a drive-joint. The chain and the belt have separate guides which involve not inconsiderable expenditure.

Finally, German Disclosure Text No. 26 55 099 discloses a massaging unit in which a stationary drive unit is provided for the reciprocating motion and an additional motor is mounted on the slide to rotate the massaging brush. The material and production costs for these two separate drive-units are correspondingly high.

It is therefore the purpose of the invention to improve a massaging device of the type mentioned at the beginning hereof in that, on the one hand the motor is arranged stationarily and, on the other hand, the slide can be locked in a predeterminable position while the massage brush continues to rotate. The massaging device ensures easy and functionally correct operation and is unaffected by external factors, contamination, etc. The device is furthermore of low overall weight and small structural volume. In addition to this, it is also possible to use the massaging device in dry areas but, if necessary, combination with a water-supply and use in a shower is possible.

In order to accomplish this purpose, it is proposed to provide an endless belt running over two deflecting rollers spaced from each other and driven by the stationarily arranged motor, and to arrange upon the slide a drive-wheel connected to the shaft and in engagement with the belt, the reversing drive, driven by the drive-wheel, being mounted on a drive-carrier. The latter is adapted to move in such a manner that the reversing drive can be selectively connected to, or disconnected from, the guide, the slide being locked in relation thereto by means of a switching element.

The stationary arrangement of the motor results in a considerable cost-reduction for the slide, the guide and the driving power required, as compared with known massaging devices in which the motor is arranged upon the slide. The drive-wheel engaging with the endless belt not only rotates the massaging brush, but also causes the slide to move. The reversing drive arranged upon the drive-carrier causes the slide to reciprocate in the desired direction. The fact that the drive-carrier is arranged to move makes it possible selectively to connect the reversing drive to, or disconnect it from, the guide, the slide being locked in relation to the said guide by means of a switching element. According to the invention, the massaging brush continues to rotate even when the slide is locked.

In one particular example of embodiment, a first gearwheel, as well as a second gearwheel of the reversing drive, are provided the drive-carrier, these gearwheels being driven in opposite directions by the drive-wheel. The drive-carrier can pivot into three positions about an axis: in two first positions, one of the gearwheels is connected at will to the guide, and in the third position, both gearwheels are disconnected from the guide. At low structural cost, therefore, the drive-carrier can be moved to one of three positions, to cause the slide to move in one direction or the other or to come to a halt, which greatly simplifies the handling and servicing of the massaging device. According to the invention, the drive-carrier pivots about the drive-wheel shaft, and this results in a particularly simple design.

According to one embodiment, the belt is a toothed belt and the drive-wheel is a gearwheel, thus ensuring, at low cost, a reliable connection between the drive-wheel and the belt.

According to another embodiment, the guide is in the form of a toothed rack and the drive-wheels are gearwheels. This provides, at low cost, an engagement which is reliable and is unaffected by external factors.

In one particular embodiment, the drive-carrier is adapted to pivot about the drive-wheel shaft, in order to simplify the design. Additional bearings, guides, or the like for the drive-carrier are unnecessary. According to the invention, the drive-carrier is mounted on the slide by means of the shaft.

In one particular embodiment, a transfer-wheel in the reversing drive is secured to the shaft to which both the drive-wheel and the massaging brush are secured, a reversing wheel being provided between the said transfer-wheel and one gearwheel. This is a simple way of establishing a drive-connection between the drive-wheel and the two gearwheels which, because of the reversing wheel, rotate in opposite directions.

In one particular embodiment, switching elements, adapted to be locked at predeterminable distances from each other, are provided in the direction of motion of the slide, thus making it position to alter the position of the drive-carrier. For instance, if, as the slide moves upwardly, the drive-carrier reaches the upper switching element, the said drive-carrier is pivoted in such a manner that the other gearwheel enters into engagement with the guide, whereupon the slide is caused to move in the other direction, i.e. downwardly. The said switching elements are adapted to be locked appropriately, for the purpose of determining not only the required length of travel of the slide, but also the points at which its direction is reversed. If these switching elements are provided with deflecting surfaces for the gearwheels, this ensures that the drive-carrier reverses reliably, without any dead-centre point.

According to a further embodiment, the drive-wheel is arranged between the two strands of the belt moving in opposite directions. By means of the sliding switching member, one part of the belt may be selectively brought into engagement with the drive-wheel or shifted away from it. If both strands of the belt are in engagement with the drive-wheel, the slide is locked in the said third position in which the massaging wheel continues to rotate. If, on the other hand, one strand of the belt is shifted away from the drive-wheel, the slide proceeds to reciprocate. This provides simple handling at low production-cost. At least one pressure-roller is preferably provided upon the sliding switching member, the purpose of the said roller being to obtain a predetermined wrap around angle between the belt and the drive-wheel for reliably transferring the movement.

In order to obtain a functional arrangement, the guide, the slide and the belt are arranged behind a cover, on the front side of which the massaging brush is located. This cover is formed with a longitudinal slot running in the direction of movement of the slide, through which the said shaft passes. Not only does this cover provide the massaging device with an attractive appearance, but it also protects, to a large extent, the components behind it from dirt and damage. The cover is preferably in the form of a profiled rail, inside of which the guide, the slide and also the belt are arranged. This provides a compact and functional construction.

In another embodiment, the massaging brush is connected to the shaft by means of a releasable coupling, particularly in the form of a rapid-action coupling, for instance a bayonet fastener or a quick thread coupling. The massaging brush may be replaced quickly, if necessary, by reversing the direction of rotation of the shaft. In order to avoid injury or damage, the massaging brush, the shaft in the vicinity of the coupling, or the coupling itself may be made flexible.

Accordingly, the invention is broadly claimed herein as a massaging device comprising: a stationary guide; belt means including an endless belt defining opposing belt strands spaced from one another and a stationary motor driving said endless belt; a slide mounted for back and forth movement along said stationary guide; a shaft rotatably mounted on said slide; a drive-wheel fixed to said shaft and in operative engagement with said belt to be rotated by said belt, said drive-wheel being further displaced along with said slide when said drive-wheel is in engagement with a single one of said strands; a drive carrier connected to said slide through said shaft; a reversing drive on said drive-carrier, operatively connected to said shaft; said drive carrier being movable with respect to said slide to allow said reversing drive to be operatively connected with said stationary guide to cause back and forth movement of said drive carrier and of said slide and to be disconnected therefrom; a massaging brush mounted at one end of said shaft to be rotated thereby, and a sliding switch on said slide movable to force the other of said strands of said endless belt against said drive-wheel to stop movement of said slide and drive-carrier, disconnection of said reversing drive from said stationary guide, and persistence of rotation of said shaft and of said massaging brush, said sliding switch being further movable away from said other strand.

The invention is explained hereinafter in greater detail in conjunction with the embodiment illustrated in the drawing attached hereto, wherein.

Figure 1:
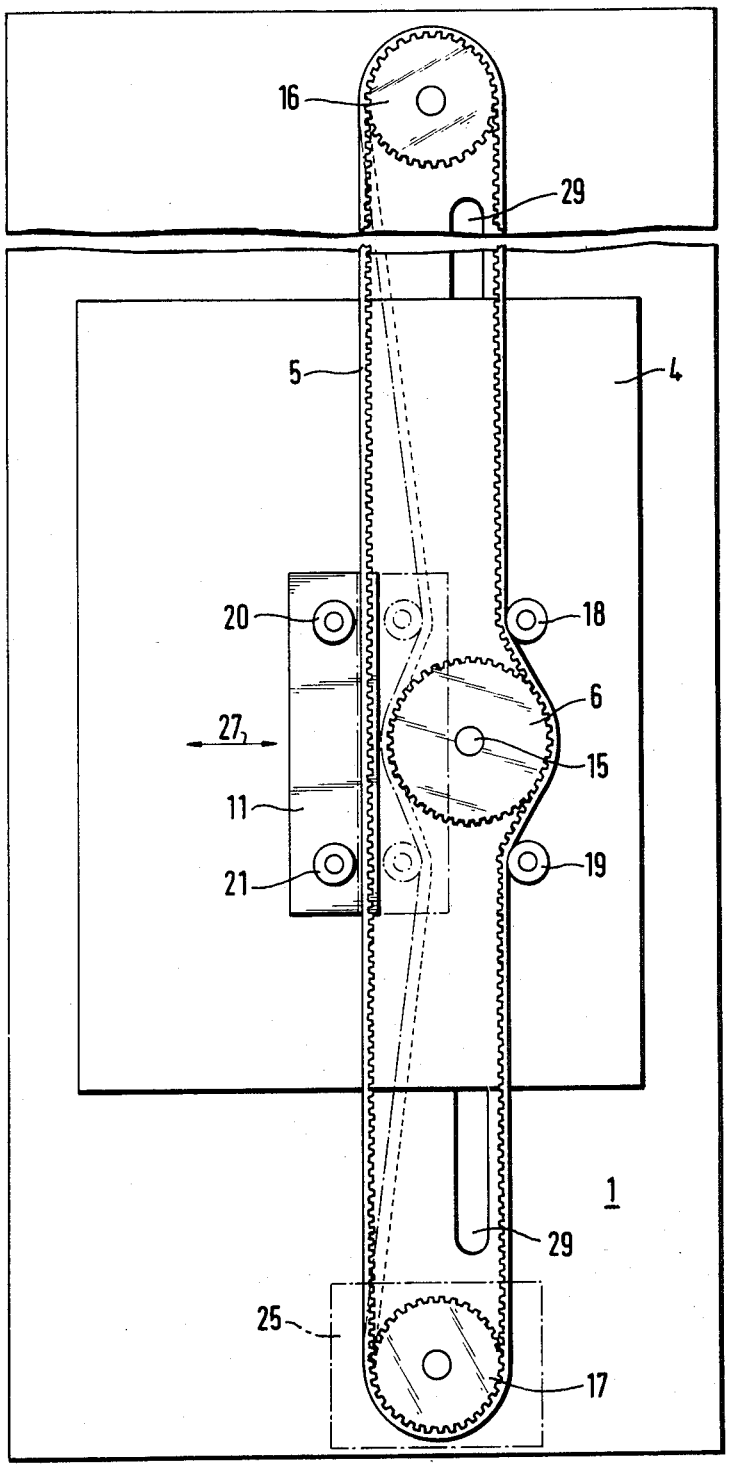
FIG. 1 is a diagrammatical rear elevation of the massaging device according to the invention.

FIG. 1 is a rear elevation of the massaging device, having a cover 1 indicated only diagrammatically, the cover 1 being in the form of a shaped rail with a slide 4 arranged in the rear inner chamber visible in this figure. The slide 4 is guided appropriately in the cover or shaped rail. Provided stationarily at the upper and lower ends are deflecting rollers 16, 17 carrying a belt 5, one of the rollers being driven by an electric motor 25. Located between the two strands of the belt running substantially parallel with each other, on the slide 4, is a drive-wheel 6 connected to a shaft 15. Pressure-rollers 18, 19 are mounted on the slide 4 and additional rollers 20, 21 are provided on sliding switch 11, capable of ensuring an adequate wrap-around angle between the belt 5 and the drive-wheel 6. The sliding switch 11 is mounted to move upon slide 4 in the direction of the double arrow 27. When the sliding switch 11 is in the left-hand position shown, only the opposing strand of the belt 5 is in engagement with the drive-wheel 6, and the belt 5 therefore causes the drive-wheel 6 to rotate and the carriage 4 to reciprocate. If, however, the sliding switch 11 is moved to the position shown in dotted lines, the belt 5 wraps around both sides of the said drive-wheel and slide 4 is locked in position. The drive shaft of the deflecting roller 17 is secured to a motor 25.

Figure 2:
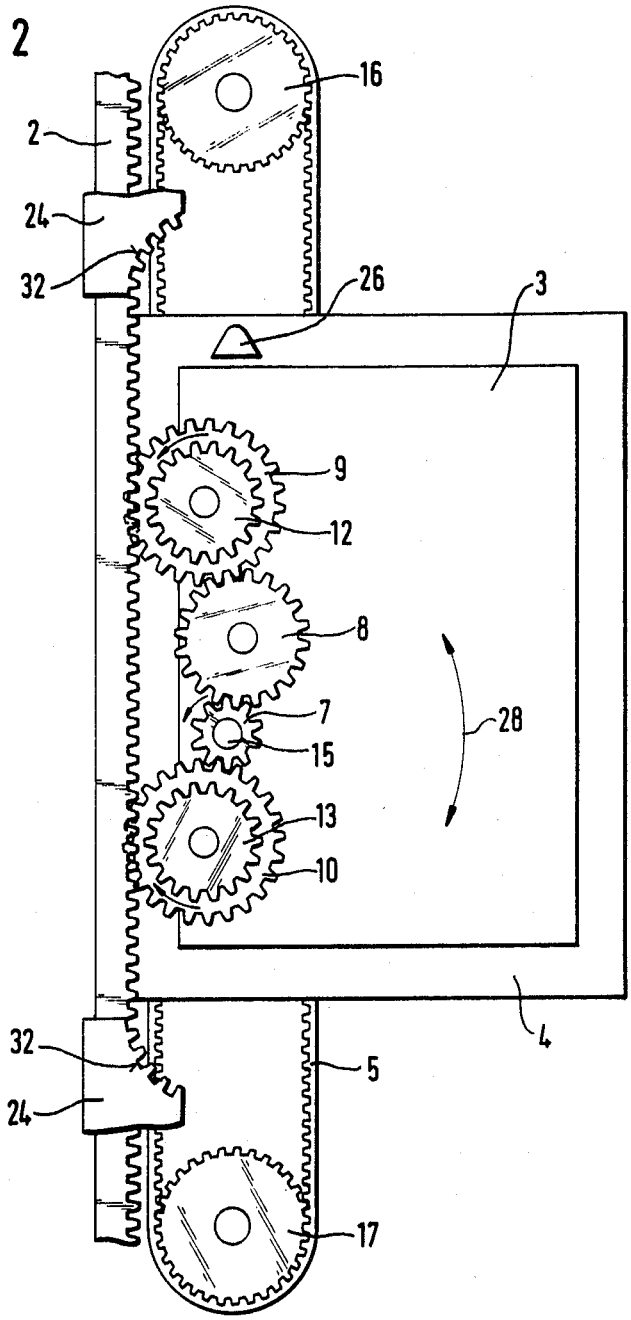
FIG. 2 is a front elevation of the massaging device according to FIG. 1, minus the cover.

FIG. 2 shows the other side of slide 4 with a drive-carrier 3 connected thereto. A transfer-wheel 7 is connected to the shaft 15 and is secured against rotation in relation thereto. Also shown is a direction-reversing drive having reversing wheels 9, 10, a change-wheel 8 being provided between the wheel 9 and transfer-wheel 7. Wheels 9 and 10 therefore rotate in opposite directions. Connected to wheels 9 and 10 are direction-wheels 12 and 13. The drive carrier 3 is mounted to pivot about the shaft 15 in the direction of the arrow 28, so that direction-wheel 12 or 13 may be brought selectively, and positively or non-positively, into engagement with the stationary guide 2. With the drive-carrier 3 in the position shown, neither direction-wheel 12 or 13 is in engagement with the stationary guide 2 and there is thus no movement of the slide. The drive-carrier 3 is in the form of a flat plate.

Upper and lower direction switching elements 24, which produce reversal of the direction of movement, are provided on the stationary guide 2. The switching elements 24 are displaceable in the direction of the guide 2 and are capable of being locked thereto in position in a suitable manner. The switching elements 24 have deflecting surfaces 32 which are a continuation of the running surface of the guide 2 and more particularly, are also toothed. For instance, if slide 4 moves upwardly and the upper direction-wheel 12 thus comes into engagement with the switching element 24, then the drive-carrier 3 is caused to pivot in a clockwise direction. As a result of this movement, the direction-wheel 13 engages with the guide 2 and the slide 4 now moves downwardly. It is essential that direction-wheel 12 roll upon curved deflecting surface 32 and that the drive-carrier 3 be fully pivoted with no dead point. Also mounted on the slide 4, and shown here diagrammatically, is a spray-nozzle 26, through which water may flow, if necessary.

Figure 3:
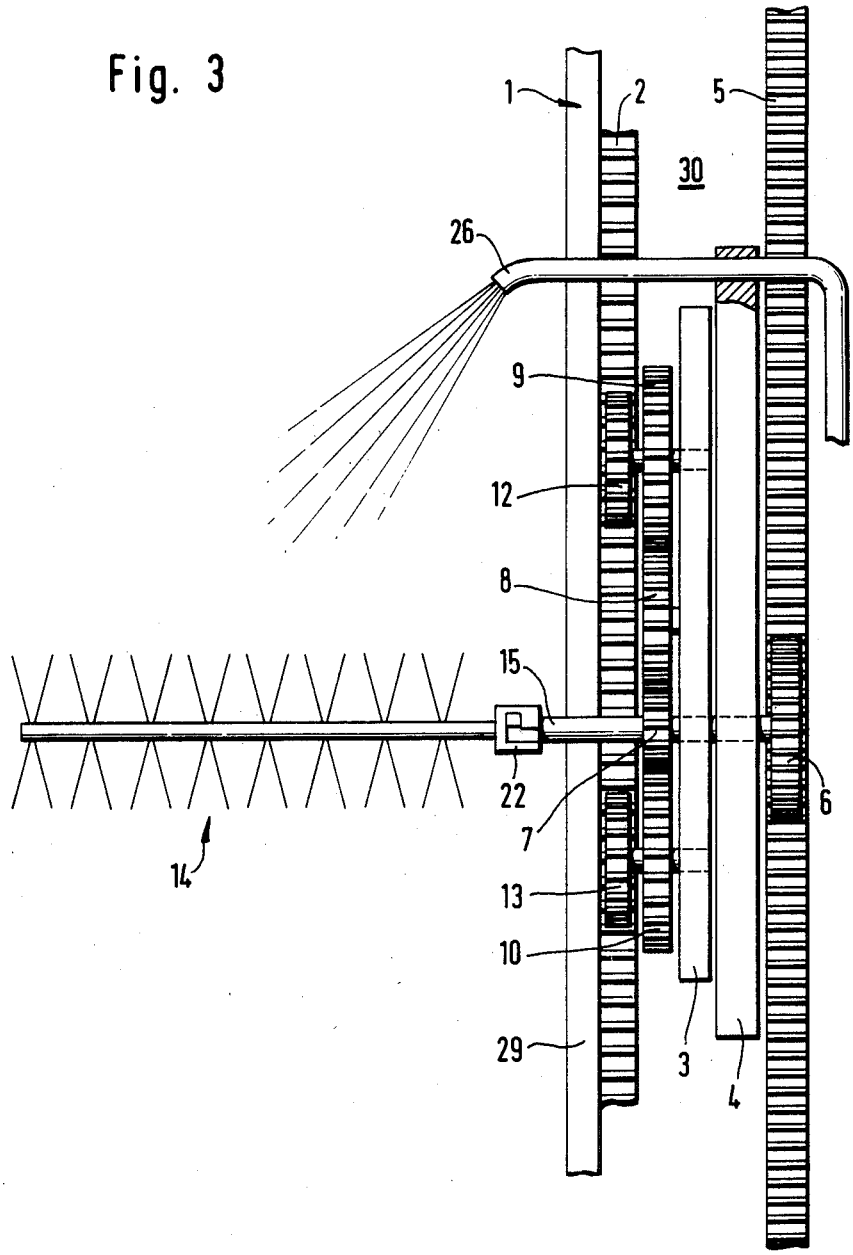
FIG. 3 is a diagrammatical side elevation.

The above-mentioned spray-nozzle 26 and the massaging brush 14, may be seen in the diagrammatical view in FIG. 3. If necessary, water may be sprayed from nozzle 26 onto the massaging brush, so that wet massaging can also be carried out. In this case, the belt 5 is in the form of a toothed belt meshing with external teeth of the drive-wheel 6. Accordingly, the guide 2 is also in the form of a toothed rack and direction wheels 12 and 13 also have external toothing.

It is expressly emphasized at this point that the above-mentioned wheels and components may, according to the invention, also engage with each other merely by friction. However, the toothing mentioned is a particularly satisfactory and reliable construction. Wheels 7 and 10 of the direction reversing drive are also preferably gearwheels. The massaging brush 14 is connected to the shaft 15 by means of a coupling 22, preferably in the form of a quick-action coupling, for instance a bayonet-fastener or a quick-thread coupling, to allow quick fitting or removal of the massaging brush. The cover 1 has a longitudinal slot 29 through which the shaft 15 passes from the inside 30 forwardly to the massaging brush 14. Apart from this, however, cover 1 is closed and slide 4, the reversing drive, the guide 2, the belt 5, and the deflecting rollers 16, 17, are all located behind the cover 1, in the interior 30 thereof.

Figure 4:
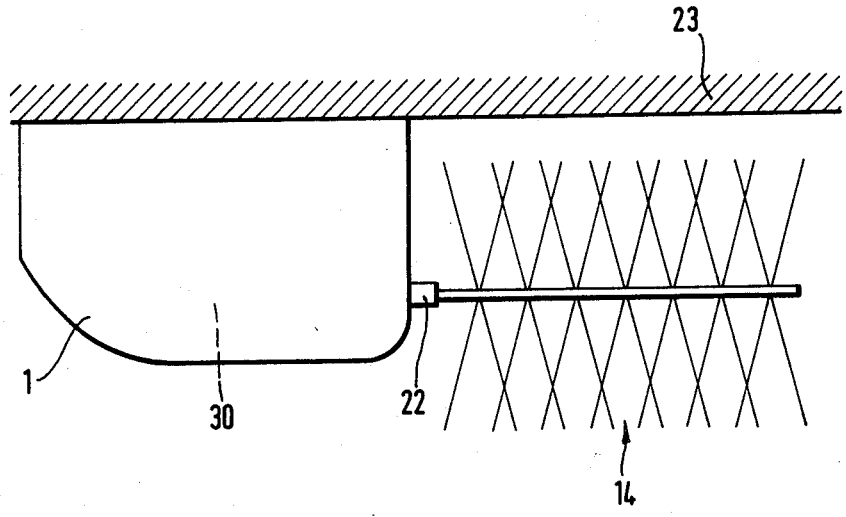
FIG. 4 is a view of a massaging device arranged on a wall.

FIG. 4 is a diagrammatical view of the massaging device secured to a wall 23 of a room. Massaging brush 14 runs parallel with the said wall. Coupling 22, which is visible in the figure, and/or the said massaging brush or the shaft, may be flexible or resilient. Thus, should large forces be applied to the massaging brush, it can deflect, thus avoiding damage to the massaging device or injury to the user.

I claim:

1. A massaging device comprising: a stationary guide; belt means including an endless belt defining opposing belt strands spaced from one another and a stationary motor driving said endless belt; a slide mounted for back and forth movement along said stationary guide; a shaft rotatably mounted on said slide; a drive-wheel fixed to said shaft and in operative engagement with said belt to be rotated by said belt; a drive carrier connected to said slide through said shaft; a reversing drive on said drive-carrier operatively connected to said shaft; said drive carrier being movable with respect to said slide to allow said reversing drive to be operatively connected with said stationary guide and to be disconnected therefrom; said slide with said shaft, drive-wheel and drive-carrier being displaced back and forth along said stationary guide and said drive-wheel engaging only one of the strands of said belt when said reversing drive is operatively connected with said stationary guide; a massaging brush mounted at one end of said shaft to be rotated thereby, and a sliding switch on said slide movable to force the other of said strands of said endless belt against said drive-wheel to stop back and forth movement of said slide and drive-carrier upon disconnection of said reversing drive from said stationary guide while permitting continued rotation of said shaft and of said massaging brush, said sliding switch being further movable away from said other strand.

2. A massaging device according to claim 1, wherein said reversing drive comprises: first and second direction-wheels engageable alternatively with said stationary guide; means rotating said direction-wheels in reverse directions; wherein said drive carrier is movable with respect to said slide by being pivotally mounted on said shaft, and means pivoting said drive-carrier into three positions: a first and a second position wherein said direction-wheels are alternatively engaged with said stationary guide and a third position where said direction-wheels are disengaged from said stationary guide.

3. A massaging device according to claim 2, wherein said belt is a toothed belt and said drive-wheel is a gear meshing with said toothed belt.

4. A massaging device according to claim 3, wherein said stationary guide is a toothed rack and said direction wheels are gears meshing with said rack.

5. A massaging device according to claim 2, wherein said reverse direction rotating means comprises: a transfer-wheel fixed to said-shaft to receive rotary power therefrom, and a change-wheel in operative engagement with said transfer-wheel, one of said direction wheels being in operative engagement with said change-wheel and the other direction-wheel being in operative engagement directly with said transfer-wheel.

6. A massaging device according to claim 2, wherein said means pivoting said drive-carrier comprise: two switching elements spaced from one another a predetermined distance in the direction of movement of said slide; said elements cooperating with one of said direction-wheels to pivot said drive-carrier and cause operative engagement of the other direction-wheel with said stationary guide.

7. A massaging device according to claim 6, wherein each of said switching elements define a deflecting surface for the bearing of said one of said direction-wheels such that the dead point is safely passed through when said drive-carrier is pivoted.

8. A massaging device according to claim 7, wherein said switching elements are secured at the ends of said stationary guide.

9. A massaging device according to claim 7, wherein said switching elements are releasably secured at the ends of said stationary guide.

10. A massaging device according to claim 2, wherein said drive-wheel is located between said two strands of said endless belt.

11. A massaging device according to claim 10, further comprising: at least one roller on said slide pressing said single one of said strands against said drive-wheel and further rollers on said sliding switch pressing, when said sliding switch is suitably displaced, said other strand against said drive-wheel.

12. A massaging device as claimed in claim 2, further comprising: a front cover having a longitudinal slot parallel to said stationary guide through which said shaft extends; wherein said stationary guide, said slide and said belt are located on one side of said cover and said massaging brush is located on the opposite side thereof.

13. A massaging device according to claim 2, wherein said cover is in the form of a shaped rail, within which said guide, said slide and said belt are located.

14. A massaging device according to claim 2, wherein said massaging brush is secured to said shaft by means of a releasable coupling.

15. A massaging device as claimed in claim 14, wherein said releasable coupling is a quick-action coupling.

16. A massaging device according to claim 15, wherein at least one of said massaging brush and said shaft in the vicinity of said coupling or said coupling are flexible.

* * * * *